US006554064B1

(12) United States Patent
Restarick et al.

(10) Patent No.: US 6,554,064 B1
(45) Date of Patent: Apr. 29, 2003

(54) METHOD AND APPARATUS FOR A SAND SCREEN WITH INTEGRATED SENSORS

(75) Inventors: Henry L. Restarick, Carrollton, TX (US); Clark E. Robison, Tomball, TX (US); Roger L. Schultz, Aubrey, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/615,016

(22) Filed: Jul. 13, 2000

(51) Int. Cl.[7] ..... E21B 43/08; E21B 47/00

(52) U.S. Cl. ..... 166/250.01; 166/227

(58) Field of Search ..... 166/250.1, 250.07, 166/250.17, 253.1, 255.1, 51, 66.4, 66.7, 230, 227, 228, 276, 278, 369

(56) References Cited

U.S. PATENT DOCUMENTS

| | | | | | |
|---|---|---|---|---|---|
| 3,688,188 | A | * | 8/1972 | Bak et al. | 324/636 |
| 4,890,682 | A | * | 1/1990 | Worrall et al. | 175/61 |
| 4,972,906 | A | * | 11/1990 | McDaniel | 166/276 |
| 5,247,156 | A | * | 9/1993 | Favre | 204/425 |
| 5,309,405 | A | * | 5/1994 | Brett et al. | 367/3 |
| 5,476,143 | A | * | 12/1995 | Sparlin et al. | 166/233 |
| 5,477,506 | A | * | 12/1995 | Allen | 181/153 |
| 5,577,559 | A | * | 11/1996 | Voll et al. | 166/278 |
| 5,579,842 | A | * | 12/1996 | Riley | 166/250.01 |
| 5,664,628 | A | * | 9/1997 | Koehler et al. | 166/369 |
| 5,730,223 | A | | 3/1998 | Restarick | |
| 5,803,170 | A | * | 9/1998 | Garcia-Soule et al. | 166/241.6 |
| 5,964,296 | A | * | 10/1999 | Ross | 166/373 |
| 6,065,535 | A | * | 5/2000 | Ross | 166/51 |
| 6,125,933 | A | * | 10/2000 | Ross | 166/250.01 |
| 2002/0007948 | A1 | * | 1/2002 | Bayne et al. | 166/278 |

FOREIGN PATENT DOCUMENTS

| | | | | |
|---|---|---|---|---|
| DE | 4141348 A1 | * | 6/1993 | B60S/1/08 |
| DE | 3503239 A1 | * | 8/1996 | E02F/7/00 |

OTHER PUBLICATIONS

Halliburton Energy Services, Inc., "Halliburton Screens", Sand Control Products and Services, 1997, pp. 5–14–5–16, H00204, Halliburton Energy Services, Inc., U.S.A.

* cited by examiner

*Primary Examiner*—David Bagnell
*Assistant Examiner*—Jennifer H Gay
(74) *Attorney, Agent, or Firm*—David W. Carstens

(57) ABSTRACT

Sensors are attached directly to portions of the sand screen of a gravel packing assembly, with connectors to the sensors run through elements of the screen that are hollow for that purpose. The hollow element can be the trapezoidal wire that is circumferentially wrapped to form the outer screen or one of the outer spacers used to provide a stand-off of the wire from the underlying tubing. Sensors can detect such conditions as pressure, temperature, flow rate, density, etc., and can provide real-time information on the effectiveness of gravel placement during packing and on well conditions during production.

39 Claims, 10 Drawing Sheets

METHOD AND APPARATUS FOR A SAND SCREEN WITH INTEGRATED SENSORS

TECHNICAL FIELD

The present invention relates to sand screens for use in the production of hydrocarbons from wells, and specifically to an improved sand screen having integrated sensors for determining downhole conditions and actuators for modifying the sand placement efficiency or controlling the production profile during the life of the reservoir.

BACKGROUND OF THE INVENTION

Many reservoirs comprised of relatively young sediments are so poorly consolidated that sand will be produced along with the reservoir fluids. Sand production leads to numerous production problems, including erosion of downhole tubulars; erosion of valves, fittings, and surface flow lines; the wellbore filling up with sand; collapsed casing because of the lack of formation support; and clogging of surface processing equipment. Even if sand production can be tolerated, disposal of the produced sand is a problem, particularly at offshore fields. Thus, a means to eliminate sand production without greatly limiting production rates is desirable. Sand production is controlled by using gravel pack completions, slotted liner completions, or sand consolidation treatments, with gravel pack completions being by far the most common approach.

In a gravel pack completion, sand that is larger than the average formation sand grain size is placed between the formation and screen or slotted liner. The gravel pack sand (referred to as gravel, though it is actually sand in grain size), should hinder the migration of formation sand. FIG. 1 illustrates an inside-casing gravel pack 10. A cased hole 8 penetrates through a production formation 6 that is enveloped by non-producing formations 2. The formation 6 has been perforated 4 to increase the flow of fluids into the production tubing 14. If formation 6 is poorly consolidated, then sand from the formation 6 will also flow into the production tubing 14 along with any reservoir fluids. A gravel pack 12 can be used to minimize the migration of sand into the tubing. A successful gravel pack 12 must retain the formation sand and offer the least possible resistance to flow through the gravel itself.

For a successful gravel pack completion, gravel must be adjacent to the formation without having mixed with formation sand, and the annular space between the screen and the casing or formation must be completely filled with gravel. Special equipment and procedures have been developed over the years to accomplish good gravel placement. Water or other low-viscosity fluids were first used as transporting fluids in gravel pack operations. Because these fluids could not suspend the sand, low sand concentrations and high velocities were needed. Now, viscosified fluids, most commonly, solutions of hydroxyethylcellulose (HEC), are used so that high concentrations of sand can be transported without settling.

Referring to FIGS. 2*a* and 2*b*, the gravel-laden fluid can be pumped down the tubing casing annulus, after which the carrier fluid passes through the sand screen and flows back up the tubing. This is the reverse-circulation method depicted in FIG. 2*a*. The gravel is blocked by a slotted line or wire wrapped screen 16 while the transport fluid passes through and returns to the surface through the tubing 18. A primary disadvantage of this method is the possibility of rust, pipe dope, or other debris being swept out of the annulus and mixed with the gravel, damaging the pack permeability. Alternatively, a crossover method is used, in which the gravel-laden fluid is pumped down the tubing 18, crosses over the screen-hole annulus, flows into a wash pipe 20 inside the screen, leaving the gravel in the annulus, and then flows up the casing-tubing annulus to the surface, as shown in FIG. 2*b*. At the point of crossover, boreseal 26 prevents mixing of the two flows.

For inside-casing gravel packing, washdown, reverse-circulation, and crossover methods are used as shown in FIGS. 3*a*, 3*b*, and 3*c*. In the washdown method, the gravel 22 is placed opposite the production interval 6 before the screen 16 is placed, and then the screen is washed down to its final position. The reverse-circulation and crossover methods are analogous to those used in open holes. Gravel 22 is first placed below the perforated interval 4 by circulation through a section of screen called the telltale screen 24. When this has been covered, the pressure increases, signaling the beginning of the squeeze stage. During squeezing, the carrier fluid leaks off to the formation, placing gravel in the perforation tunnels. After squeezing, the washpipe is raised, and the carrier fluid circulates through the production screen, filling the casing-production screen annulus with gravel. Gravel is also placed in a section of blank pipe above the screen to provide a supply of gravel as the gravel settles.

As shown in FIG. 5, the outer screen wire 50 is typically 90 mils wide by 140 mils tall in a generally trapezoidal cross-section. The maximum longitudinal spacing A between adjacent turns of the outer wire wrap is determined by the maximum diameter of the fines that are to be excluded. Typically, the aperture spacing A between adjacent wire turns is 20 mils.

Another form of sand control involves a tightly wrapped wire around a mandrel having apertures, wherein the spacing between the wraps is dimensioned to prevent the passage of sand. FIGS. 4 and 5 illustrate such a sand screen 10. The primary sand screen 10 is a prepacked assembly that includes a perforated tubular mandrel 38 of a predetermined length, for example, 20 feet. The tubular mandrel 38 is perforated by radial bore flow passages 40 that may follow parallel spiral paths along the length of the mandrel 38. The bore flow passages 40 provide for fluid through the mandrel 38 to the extent permitted by an external screen 42 and, when utilized, the porous prepack body (not specifically shown) and an internal screen 44. Screen 44 has its separate wire wrapping 64 and spacers 66. The bore flow passages 40 may be arranged in any desired pattern and may vary in number in accordance with the area needed to accommodate the expected formation fluid flow through the production tubing 18.

The perforated mandrel 38 preferably is fitted with a threaded pin connection 46 at its opposite ends for threaded coupling with the polished nipple (not specifically shown) and the production tubing 18. The outer wire screen 42 is attached onto the mandrel 38 at opposite end portions thereof by annular end welds 48. The outer screen 42 is a fluid-porous, particulate restricting member that is formed separately from the mandrel 38. The outer screen 42 has an outer screen wire 50 that is wrapped in multiple turns onto longitudinally extending outer ribs 52, preferably in a helical wrap. The turns of the outer screen wire 50 are longitudinally spaced apart from each other, thereby defining rectangular fluid flow apertures therebetween. The apertures are framed by the longitudinal ribs 52 and wire turns for conducting formation fluid flow while excluding sand and other unconsolidated formation material.

As shown in FIG. 5, the outer screen wire 50 is typically 90 mils wide by 140 mils tall in a generally trapezoidal cross-section. The maximum longitudinal spacing A between adjacent turns of the outer wire wrap is determined by the maximum diameter of the fines that are to be excluded. Typically, the aperture spacing A between adjacent wire turns is 20 mils.

The outer screen wire 50 and the outer ribs 52 are formed of stainless steel or other weldable material and are joined together by resistance welds (not specifically shown) at each crossing point of the outer screen wire 50 onto the outer ribs 52 so that the outer screen 42 is a unitary assembly which is self-supporting prior to being mounted onto the mandrel 38. The outer ribs 52 are circumferentially spaced with respect to each other and have a predetermined diameter for establishing a prepack annulus 54 of an appropriate size [for receiving the annular prepack body 58, described hereafter]. The longitudinal ribs 52 serve as spacers between the inner prepack screen 44 and the outer screen 42. The fines which are initially produced following a gravel pack operation have a fairly small grain diameter, for example, 20–40 mesh sand. Accordingly, the spacing dimension A between adjacent turns of the outer screen wire 50 is selected to exclude sand fines that exceed 20 mesh.

Clearly, the design and installation of sand control technology is expensive. Yet, there is a drawback to all of the prior art discussed, namely the lack of feedback from the actual events at the formation face during completion and production. A need exists for the ability to detect conditions at the sand screen and convey that information reliably to the surface. Nothing in the prior art discloses a convenient way to provide for the passage of the conductors across a sand screen assembly. And yet were sensors to be placed inside and around the sand screen numerous benefits would be realized.

Sensors could be chosen that would provide real time data on the effectiveness of the sand placement operation. Discovering voids during the placement of the sand would allow the operator to correct this undesirable situation. Additionally, sensors could provide information on the fluid velocity through the screen, which is useful in determining the flow profile from the formation. Furthermore, sensors could provide data on the constituent content of oil, water and gas. All of these streams of information will enhance the operation of the production from the well.

SUMMARY OF THE INVENTION

The present invention relates to an improved sand screen, and, a method of detecting well conditions during sand placement and controls that allow modification of operational parameters. The sand screen includes at least one sensor directly coupled to the sand screen assembly and at least one actuator capable of affecting sand placement distribution, packing efficiency and controlling well fluid ingress. Each of the benefits described can be derived from the use of a sensor and actuator integrated into the sand screen.

A variety of sensors can be used to determine downhole conditions during the placement of the sand and later when produced fluids move through the screen into the production tubing string. This allows real time bottom hole temperature (BHT), bottom hole pressure (BHP), fluid gradient, velocity profile and fluid composition recordings to be made before the completion, during completion and during production with the production seal assembly in place. One particularly beneficial application for the use of sensors on the sand screen includes the measurement and recordation of the displacement efficiency of water based and oil based fluids during circulation. A user can also record alpha and beta wave displacement of sand. Sensors on the sand screen also allow measurement of after pack sand concentrations; as well as sand concentrations and sand flow rates during completion. Sensors also allow the determination of the open hole caliper while running in hole with the sand screen, which would be very useful in determining sand volumes prior to the placement of the sand. Sensors can allow the user to record fluid density to determine gas/oil/water ratios during production and with the provision for controlling/modifying the flow profiles additional economic benefits will result, which will be discussed in more detail below. Temperature sensors can identify areas of water entry during production. The use of sensors also allows the determination of changes in pressure drops that is useful in determining permeability, porosity and multi-skins during production. Sensor data can be used to actuate down hole motors for repositioning flow controls to modify the production profiles and enhance the economic value of the completion in real time.

Sensor data may be fed into microprocessors located either at or near the sensor or alternatively at the surface. The microprocessor determines an optimum flowing profile based on pre-determined flow profiles and provides a control signal to an actuator to change the flow profile for a particular section of sand screen. A simple embodiment of this is shown in FIG. 10. An electric motor could be energized, based on the control signal, and the motor could operate a compact downhole pump. As the pump displaces fluid into a piston chamber, the piston would be urged to a new position and the attached flow control would then modify the production profile of that portion of sand screen. Many alternative flow controls could also be operated in a similar fashion.

Furthermore, in general, most gravel pack assemblies, which includes the sand screen assembly, are run into the wellbore and spaced across a single zone to be gravel packed. If several zones are to be gravel packed within the same wellbore, then a separate gravel pack assembly must be run into the wellbore for each zone. Each trip into the wellbore requires more rig time with the attendant high operating cost related to time. Recent technology offers a gravel pack system, which allows the operator to run a gravel pack assembly that is spaced across multiple producing zones to be gravel packed. Each zone is separated and isolated from the other zones by a downhole packer assembly. This multi-zone gravel pack assembly is run into the wellbore as a single trip assembly which includes the improved sand screen with sensors and actuators.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

The present invention relates to an improved sand screen that incorporates sensors and a means for conveying the sensor data to the surface. In each embodiment, at least one sensor is attached to a sand screen element. Information from the sensor may be conveyed to the surface by either a direct wireline connection or by a transmitter or a combination of the two. When a microprocessor is included in the downhole system sending information to the surface is redundant and may not need to occur. Any number of sensor types can be used. For example, a pressure sensor and/or temperature sensor can provide particularly important feedback on well conditions. By placing the sensors on the sand screen, the well condition data is measured and retrieved immediately and any associated action may be performed by the integrated actuators. Thus, dangerous well conditions such as a blowout are detected before the effects damage surface equipment or injure personnel. Typically, pressure measurements are only taken at the surface, often relaying information too late, or, the sensors are placed too distant from the sand screen to provide any useful information regarding the sand placement operations. Early detection can allow mitigating actions to be taken quickly, such as activating an actuator to enhance sand distribution or closure of a subsurface flow control to optimize the production profile.

Figure 6:
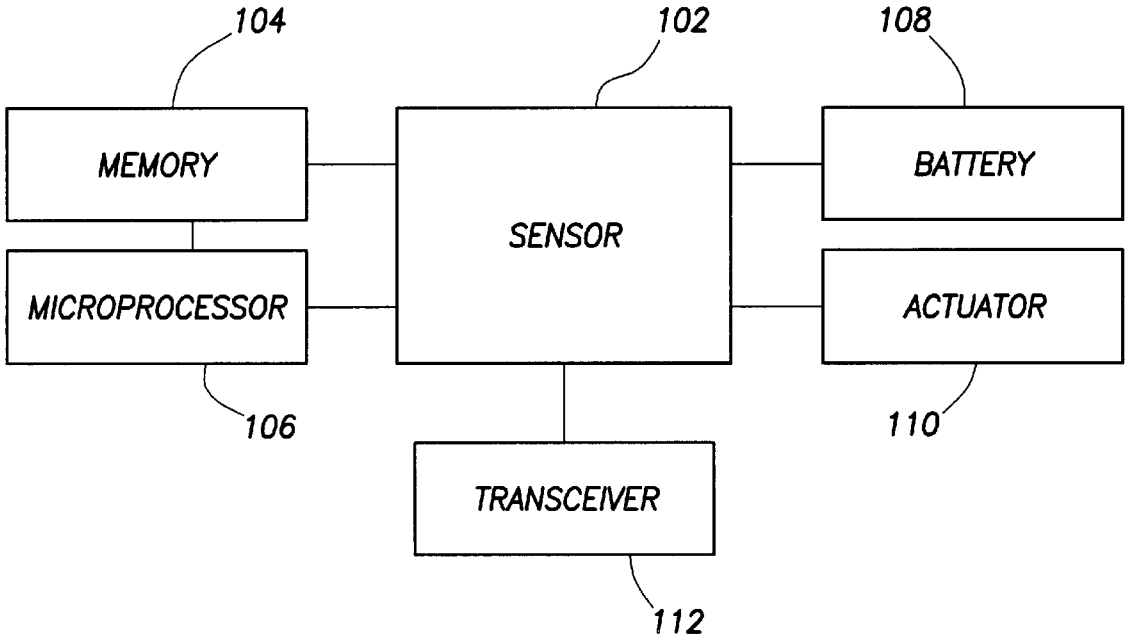
FIG. 6 is a block diagram of a sensor used in the present invention

For purposes of this disclosure, the sensor could be a pressure sensor, a temperature sensor, a piezo-electric acoustic sensor, a flow meter for determining flow rate, an accelerometer, a resistivity sensor for determining water content, a velocity sensor, or any other sensor that measures a fluid property or physical parameter. The term sensor means should be read to include any of these sensors as well as any others that are used in downhole environments and the equivalents to these sensors. FIG. 6 illustrates a general block diagram of a sensor configuration as used by the present invention. The sensor 102 can be powered by a battery 108, in one embodiment, or by a wired to a power source in another embodiment. Of course, a battery has a limited useful life. However, it might, be adequate if the sensor data was only needed for a limited period of time. Likewise, a transmitter 112 could be used to send data from the sensor to a surface or subsurface receiver. The transmitter could also be battery powered. The sensor could also be fitted with a transceiver 112 that would allow it to receive instructions. For example, to conserve battery power, the sensor might only be activated upon receipt a "turn on" command. The sensor might also have a microprocessor 106 attached to it to allow for manipulation and interpretation of the sensor data. Likewise, the sensor might be coupled to a memory 104 allowing it to store information for later batch processing or batch transmission, or to an actuator 110 for controlling downhole flow. Furthermore, a combination of these components could provide for localized control decisions and automatic actuation.

Another option for power and data retrieval is a hardwired connection to the surface. This requires the use of an electrical conductor that can couple the sensor to a power source and/or be used to transmit the data. During completion operations, the completion string is pieced together from individual lengths of tubing. Each is screwed together and then lowered into the well. A coupling is formed between adjacent pieces of tubing the completion string. FIG. 7*c* depicts a clamshell device that simplifies the electrical continuity across these threaded joints.

Figure 7A:
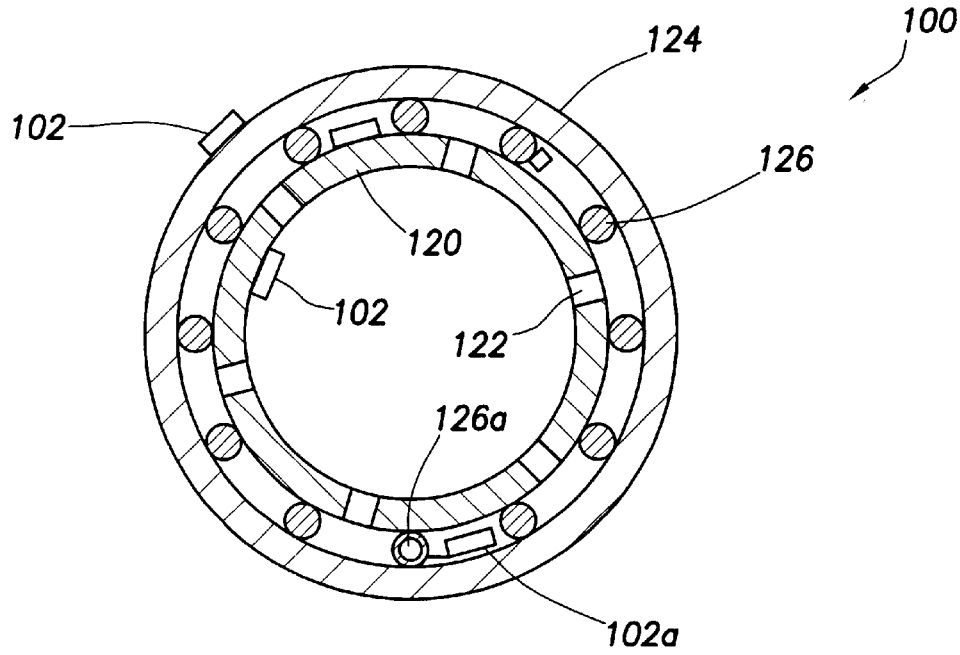
FIGS. 7*a*, 7*b*, 7*c* and 7*d* illustrate a novel sensor and power wire placement in accordance with the present invention.
Figure 7B:
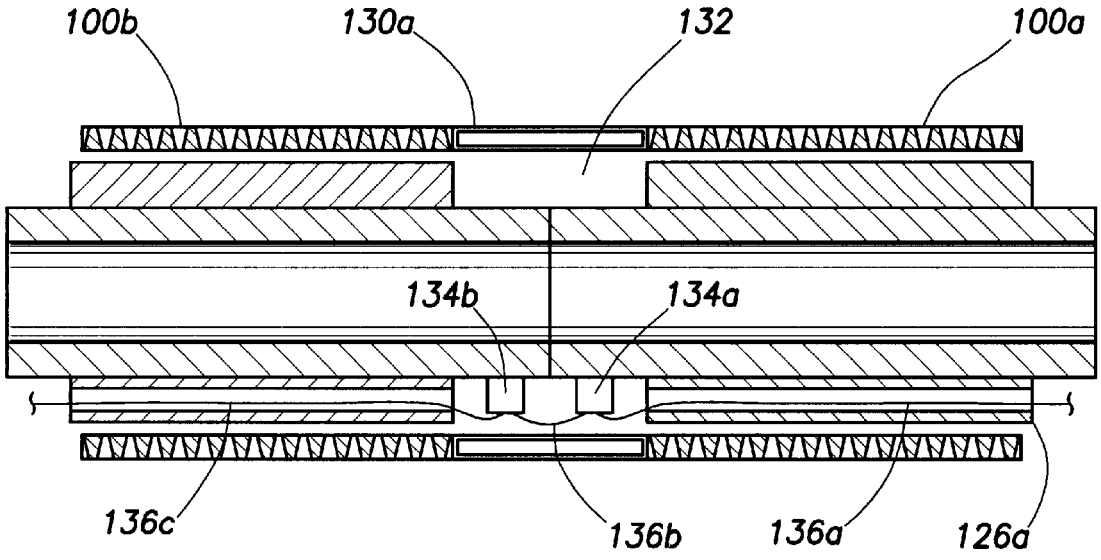
Figure 7C:
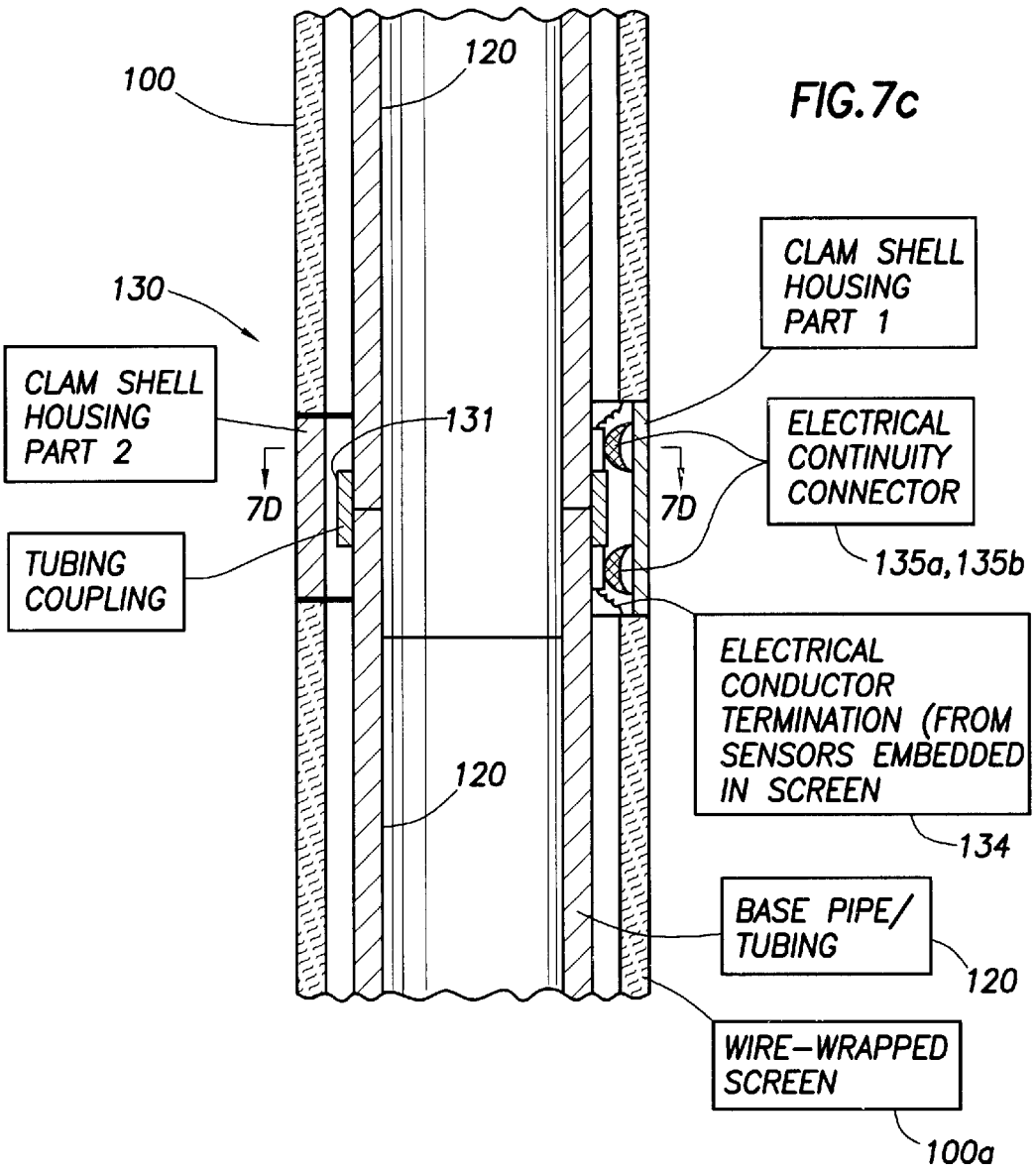

FIGS. 7*a* and 7*b* illustrate a first embodiment 100 of the present invention. An inner mandrel 120 can have a plurality of flow apertures 122. As with prior art designs, an outer screen 124 is used to minimize the flow of sand through apertures 122 and into the production tubing. The outer screen 124 is spaced apart from the inner mandrels by a plurality of rods 126 coupled to the inner mandrel 120. A sensor 102 is shown attached to the inner surface of the outer screen 124. However, a sensor 102*a* could also be placed on the inner mandrel 120 or coupled to a hollow rod 126*a*, where its connectors can be carried. Indeed, in one embodiment, a sensor could even be placed on the outer surface of the outer screen or inside the mandrel. Each of these placements may present its own engineering challenge with regards to survivability, but in each case, the sensor is still relatively close to the interface with the production interval.

FIG. 7*b* illustrates a joint between two adjacent sections of sand screen, with details on the electrical connections for the sensors. The joint has a threaded portion (not specifically shown) to connect adjacent sections of the inner mandrel. An outer sleeve 130*a* protects the electrical connections and creates an annular space 132. Within this annular space, a first connector 134*a* is a termination point for the conductor 136*a* that is carried inside the spacer 126*a* in the first section 100*a*. The conductor is typically an electrical wire, although it could also be a coaxial cable or any other signal transmission medium. A conductor 136*b* is located between the first connector 134*a* and second connector 134*b*. Another length of conductor 136*c* is located in the second section 100*b*. Thus, in practice, the sections are brought together. Conductor 136*a* is connected to connector 134*a*, while conductor 136*c* is connected to connector 134*b*.

Figure 7D:
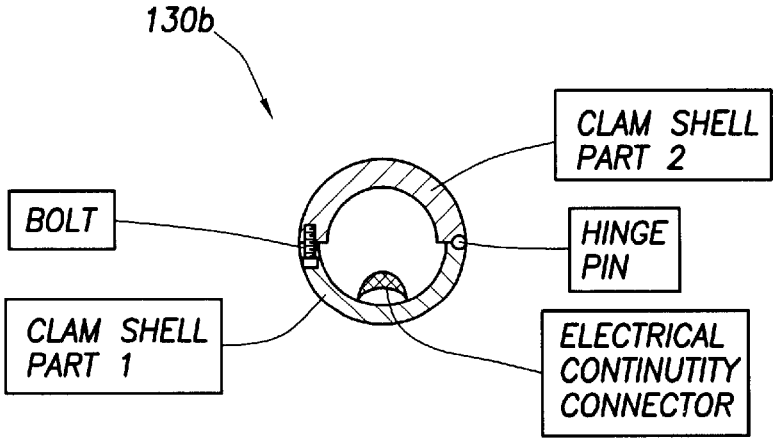

FIGS. 7*c* and 7*d* depicts a clam shell device 130*b* that simplifies the electrical connection across the threaded joints. In this embodiment, the electrical connectors are carried inside the hollow wire wrapping which forms the outer screen 124. The sand screen sections are threaded together using female couplings 131 as shown. The electrical conductor termination blocks 134 are mounted to a blank portion of the screen inner mandrel 120. The two piece clam shell continuity device 130*b* has matching spring loaded continuity connectors 135*a* and 135*b* that engage the conductor termination blocks to promote a high grade electrical connection. The clam shell pieces, which are connected to each other by a hinge pin and bolt, are attached after the tubing is threaded together.

Figure 8A:
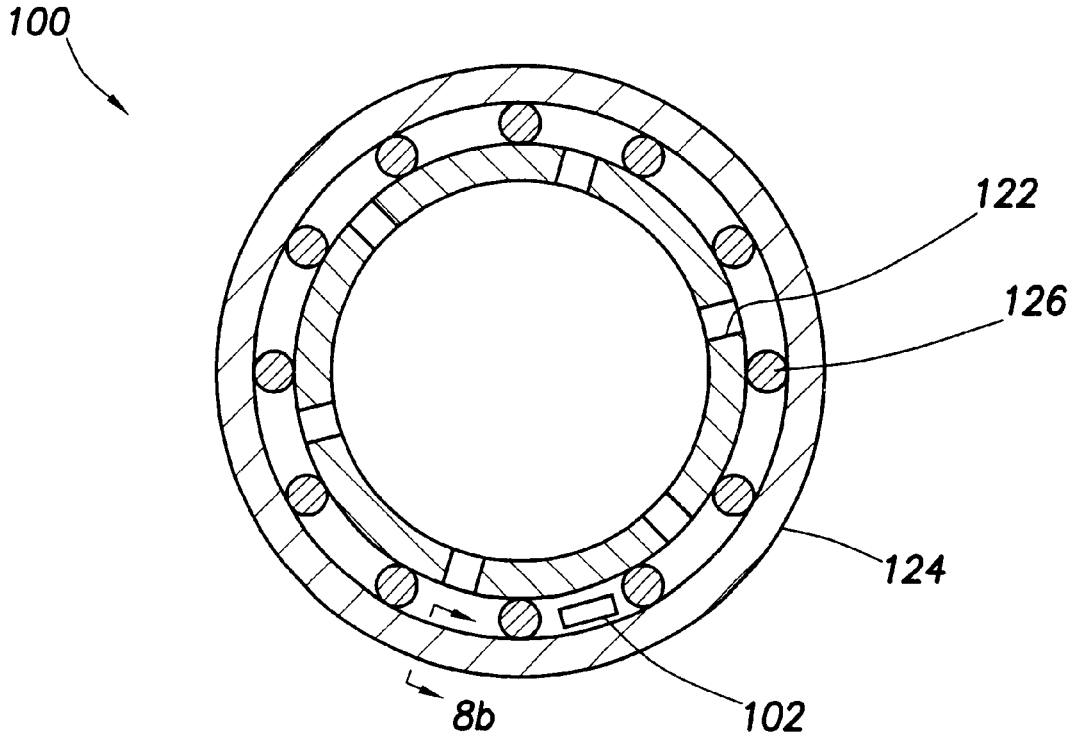
FIGS. 8*a* and 8*b* illustrate another embodiment of the present invention wherein the power wire is located in a hollow wire used to wrap the gravel pack assembly.
Figure 8B:
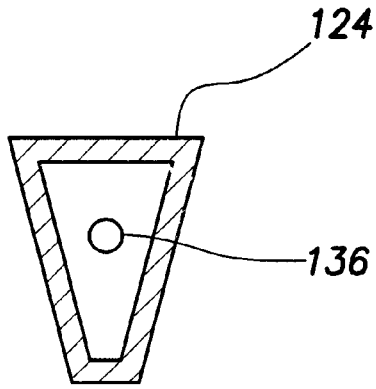

FIGS. 8*a* and 8*b* illustrate another embodiment of the invention wherein multiple sensors are placed within a gravel pack assembly. An inner mandrel 120 can have a plurality of flow apertures 122. As with prior art designs, an outer screen 124 is used to minimize the flow of sand through apertures 122 and into the production tubing. The outer screen 124 is spaced apart from the inner mandrels by a plurality of rods 126 coupled to the inner mandrel 120. A sensor 102 is shown attached to the inner surface of the outer screen 124. Again, the sensor can be placed in several different locations on the gravel pack assembly. Indeed, if multiple sensors are used, several may be on the inner surface of the outer screen, while others are attached to rods and so forth. A novel aspect of this embodiment is the location of the conductor that is located within the wire wrap that constitutes the outer screen. The outer screen can be a wrap of generally hollow wire. A conductor 136 can be nested within that wire wrap. The conductor 136 can be used for both power supply to the sensor(s) or data transmission to the surface.

Figure 9A:
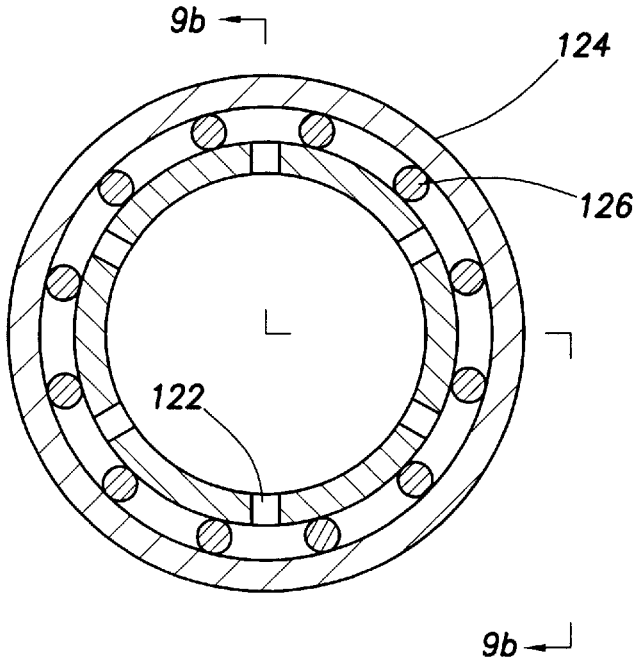
FIGS. 9*a* and 9*b* illustrate the sensor placement along the inside mesh of the gravel pack assembly.
Figure 9B:
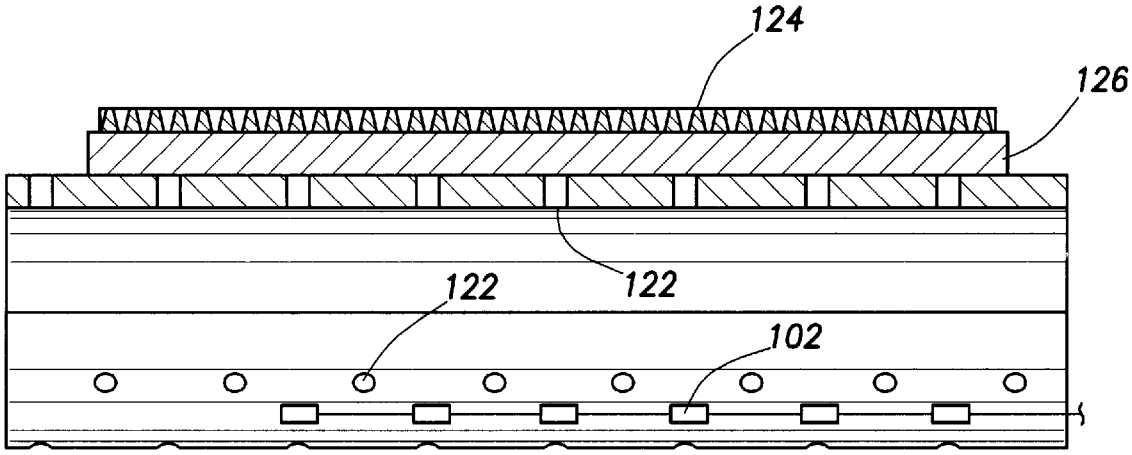

FIGS. 9*a* and 9*b* illustrate the use of multiple sensors along the length of a gravel pack assembly. A single conductor 136 can connect each of these sensors. For this embodiment, each sensor in the array can be given an address. And while a (1)×(6) array is shown, any (X)×(Y) array of sensors can be used.

An important advantage of placing sensors on the sand screen is the ability to determine how well the gravel has been placed during completion. For instance, the gravel pack has a density. This density could be determined using a piezo-electric material (PEM) sensor. The sensor has a resonant frequency that is damped in higher density fluids. Thus, a PEM sensor can be used to determine the quality of sand placement. If placement is inadequate, a special tool such as a vibrator can be used to improve gravel placement.

The placement of multiple sensors on a sand screen also allows more precise measurement of "skin effect." The well skin effect is a composite variable. In general, any phenomenon that causes a distortion of the flow lines from the perfectly normal to the well direction or a restriction to flow would result in a positive skin effect. Positive skin effects can be created by mechanical causes such as partial completion and an inadequate number of perforations. A negative skin effect denotes that the pressure drop in the near wellbore zone is less than would have been from the normal, undisturbed, reservoir flow mechanisms. Such a negative skin effect, or a negative contribution to the total skin effect, may be the result of matrix stimulation, hydraulic fracturing, or a highly inclined wellbore. It is important to realize that there may be high contrasts in skin along the length of the production interval. Thus, the use of multiple sensors allows the detection of the specific locations of positive skin indicating damage. This allows corrective action to be taken.

Multiple sensors also allow the detection of flow rates and flow patterns. For instance, gravel placement typically displays an alpha wave and a beta wave during completion. The alpha wave refers to the initial gravel buildup from the bottom of the hole up along the sides of the sand screen. The beta wave refers to the subsequent filling from the top back down the side of the initial placement.

Figure 10:
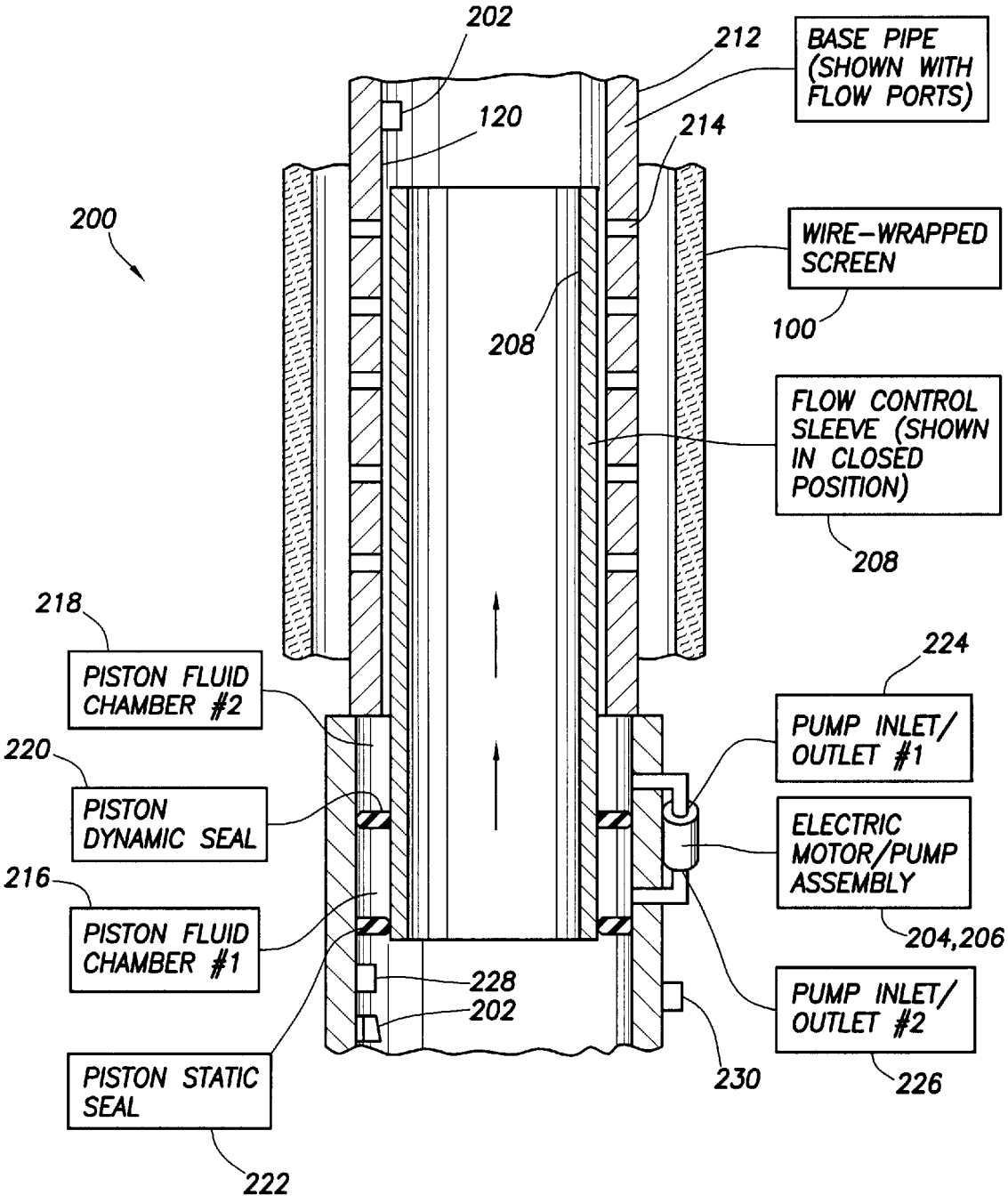
FIG. 10 shows an actuator and flow control system.

FIG. 10 shows an embodiment of a control system 200. The control system can include multiple sensors 202, a microprocessor 204, a motor/pump assembly 206 and a hydraulically positionable sleeve 208. In one embodiment, a first and second sensor 202 are located on the internal surface of inner mandrel 120. These sensors 202 can be used to determine internal tubing fluid conditions such as temperature, pressure, velocity and density. Signals from the sensor 202 are interpreted by the microprocessor 204. The microprocessor 204 is typically housed within the motor/pump assembly 206.

The sleeve is moved to block the selectively the ports 214 in the base pipe 212. The sleeve is moved by pumping fluid into either a first chamber 216 or a second chamber 218. These chambers are divided by seals 220, 222. A control signal, such as an AC voltage, is sent to the motor 206 and the pump delivers hydraulic fluid to the chamber to move the sleeve 208. As shown, a sleeve 208 is moved to a position where the flow ports are covered thereby restricting flow, but alternative flow port arrangements abound in practice and this one example should not limit the scope of the present system. In use, the motor/pump assembly 206 is given a control signal from the microprocessor to operate. A first port 224 is the inlet port and port 226 is the outlet port in configuration. Fluid fills chamber 218 in this case and the flow control sleeve is moved to the closed position as shown. When flow is desired, the pump is operated in the opposite direction and fluid is moved from chamber 216 to chamber 218 and the piston moves the flow control sleeve to the opposite extreme and the flow ports in the base pipe are uncovered allowing flow to recommence. A sensor 228 can be used to determine the position of the sleeve 208. Likewise, a sensor 230 can be used to determine well conditions outside of the tubing.

The description of the present invention has been presented for purposes of illustration and description, but is not limited to be exhaustive or limited to the invention in the form disclosed. Many modifications and variations will be apparent to those of ordinary skill in the art. For example, while data transmission has been described as either by wireless or wireline, a combination of the two could be used. The embodiment was chosen and described in order to best explain the principles of the invention the practical application to enable others of ordinary skill in the art to understand the invention for various embodiments with various modifications as are suited to the particular use contemplated.

We claim:

1. A gravel pack comprising:

a sand screen having an inner mandrel with at least one aperture therethrough, and an outer mesh separated from said mandrel by a spacer; and a sensor directly coupled to said sand screen.

2. The gravel pack of claim 1 wherein said sensor is coupled to said outer mesh.

3. The gravel pack of claim 1 wherein said sensor is coupled to said inner mandrel.

4. The gravel pack of claim 1 further comprises power means for powering the sensor.

5. The gravel pack of claim 4 wherein said power means comprises a battery coupled to the sensor.

6. The gravel pack of claim 4 wherein said power means comprises a conductor from the sensor to a surface power source.

7. The gravel pack of claim 1 wherein said sensor comprises a pressure sensor.

8. The gravel pack of claim 1 wherein said sensor comprises a temperature sensor.

9. The gravel pack of claim 1 wherein the sensor comprises a sensor made of a piezo-electric material.

10. The gravel pack of claim 1 wherein said sensor comprises a density meter.

11. The gravel pack of claim 1 wherein said sensor comprises an accelerometer.

12. The gravel pack of claim 1 wherein said spacer comprises a plurality of rods.

13. The gravel pack of claim 12 wherein at least one rod is substantially hollow and contains a conductor coupled to the sensor.

14. The gravel pack of claim 1 wherein said outer mesh comprises a substantially hollow wire wrapped circumferentially around the spacer, wherein a conductor is located within said hollow wire.

15. The gravel pack of claim 1 further comprises a memory coupled to the sensor.

16. The gravel pack of claim 1 further comprises a microprocessor coupled to the sensor.

17. The gravel pack of claim 1 further comprises a transmitter coupled to the sensor.

18. The gravel pack of claim 1 further comprises a receiver coupled to the sensor.

19. The gravel pack of claim 1 further comprises a transceiver coupled to the sensor.

20. The gravel pack of claim 1 further comprises an actuator coupled to the sensor.

21. The gravel pack of claim 20 wherein said actuator is a vibrator.

22. The gravel pack of claim 20 wherein said actuator is a hydraulically positionable piston.

23. The gravel pack of claim 20 wherein said gravel pack system is a single trip multi-zone gravel pack assembly.

24. A method of collecting data from a downhole environment comprising the steps of:

(a) lowering a gravel pack assembly into the downhole environment; wherein a sensor is directly coupled to a sand screen which forms a portion of said gravel pack assembly; and (b) collecting data from the sensor.

25. The method of claim 24 wherein step (a) further comprises coupling the sensor to an outer screen of said sand screen.

26. The method of claim 24 wherein step (a) further comprises coupling the sensor to an inner mandrel of said sand screen.

27. The method of claim 24 wherein step (b) comprises coupling the sensor to a data collector with a conductor located in a hollow spacer between an outer mesh and an inner mandrel of the assembly.

28. The method of claim 24 wherein step (b) comprises coupling the sensor to a data collector with a conductor located in a hollow wire wrapped around an inner mandrel of the assembly.

29. The method of claim 24 further comprises:

actuating a downhole device in response to a data signal from the sensor.

30. A method for placing sand around a gravel pack assembly including the steps of:

(a) gathering data in real time from a sensor directly coupled to a sand screen of a gravel pack assembly;

(b) flowing a sand suspended in a fluid into said assembly wherein sand is deposited between said sand screen and a formation;

(c) actuating a vibrator that redistributes sand between said sand screen and the formation.

31. A method for modifying a production profile in a producing well including the steps of:

(a) sensing a flow characteristic or a fluid parameters from sensors located on a sand screen in the well; wherein said sand screen is located adjacent to a production region; and (b) motivating an actuation system to reconfigure the flow area through the screen.

32. The method of claim 31 wherein step (b) further comprises hydraulically actuating a positionable sleeve; wherein said sleeve is slidable over a port in an inner mandrel of said sand screen.

33. A device for use in the production of hydrocarbons from wells, said device comprising:

a sand screen having a connection at one end for attachment to a tool string for a borehole; and a sensor directly attached to said sand screen.

34. The device of claim 33 wherein said sensor is coupled to an outer mesh of said sand screen.

35. The device of claim 33 wherein said sensor is coupled to an inner mandrel of said sand screen.

36. The device of claim 33 further comprising a battery coupled to said sensor.

37. The device of claim 33 further comprising a conductor from said sensor to a surface power source.

38. The device of claim 33 wherein said sensor comprises one of a group consisting of a pressure sensor, a temperature sensor, a density meter, and an accelerometer.

39. The device of claim 33, wherein said sensor is coupled to one of a group consisting of a memory, a microprocessor, a transmitter, a receiver, a transceiver, and an actuator.

* * * * *

UNITED STATES PATENT AND TRADEMARK OFFICE

CERTIFICATE OF CORRECTION

PATENT NO. : 6,554,064 B1 
DATED : April 29, 2003
INVENTOR(S) : Henry L. Restarick, Clark E. Robison and Roger L. Schultz It is certified that error appears in the above-identified patent and that said Letters Patent is hereby corrected as shown below:

Column 3,
Line 16, please delete the bracket "[" before "for"
Line 17, please delete the bracket "]" after "hereafter"

Signed and Sealed this

Sixth Day of January, 2004

JAMES E. ROGAN
*Director of the United States Patent and Trademark Office*

UNITED STATES PATENT AND TRADEMARK OFFICE

CERTIFICATE OF CORRECTION

Figure 1:
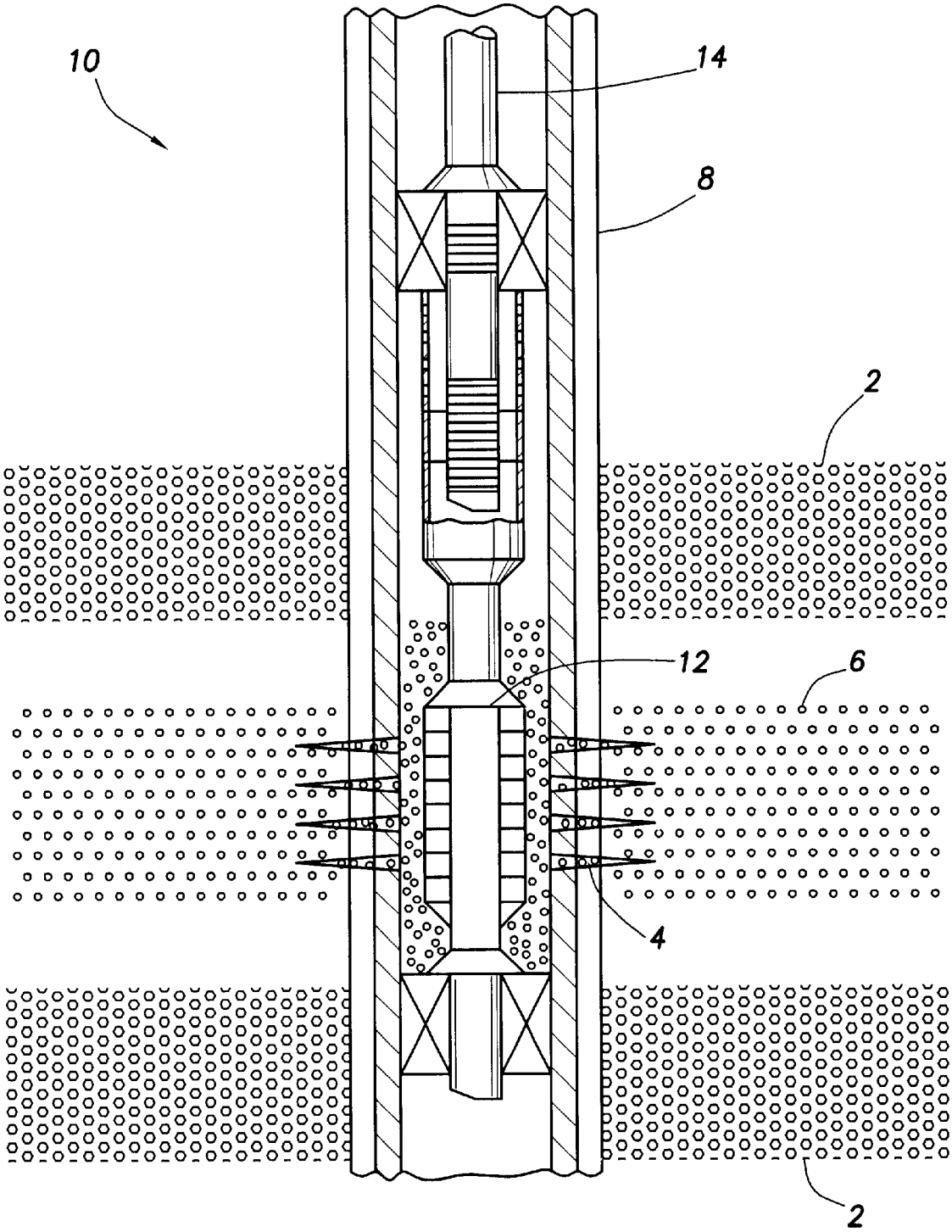
FIG. 1 (PRIOR ART)
FIG. 1 is a sectional view across a well showing a prior art gravel pack completion.
Figure 2B:
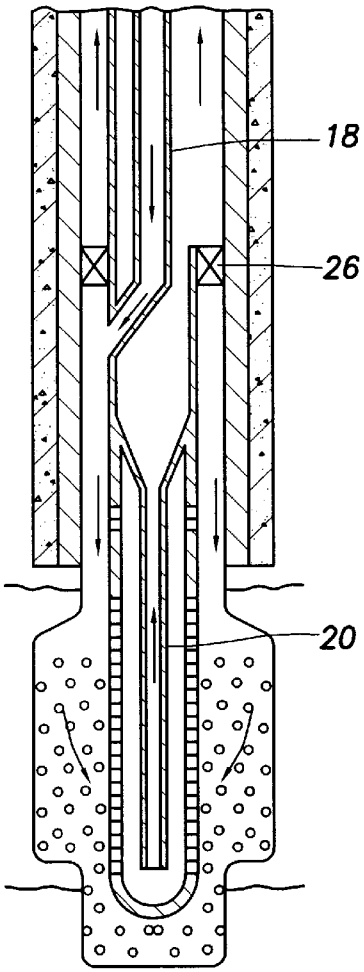
FIG.2b (PRIOR ART)
FIGS. 2*a* and 2*b* illustrate prior art methods of gravel placement in open-hole or under-reamed casing completions.
Figure 2A:
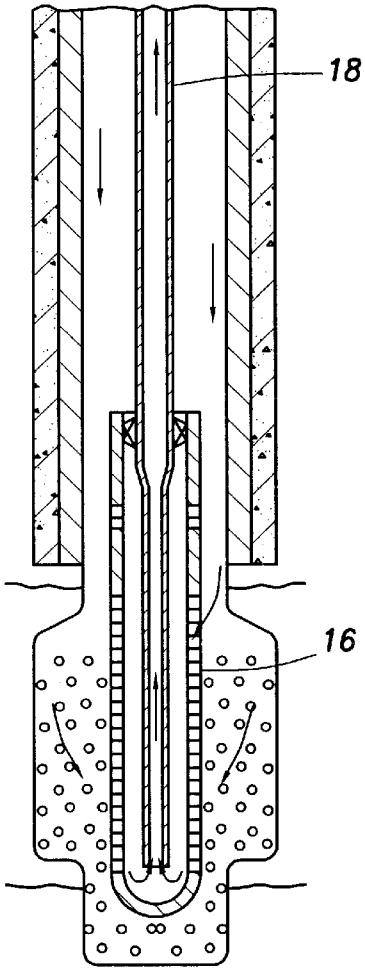
FIG.2a (PRIOR ART)
Figure 3C:
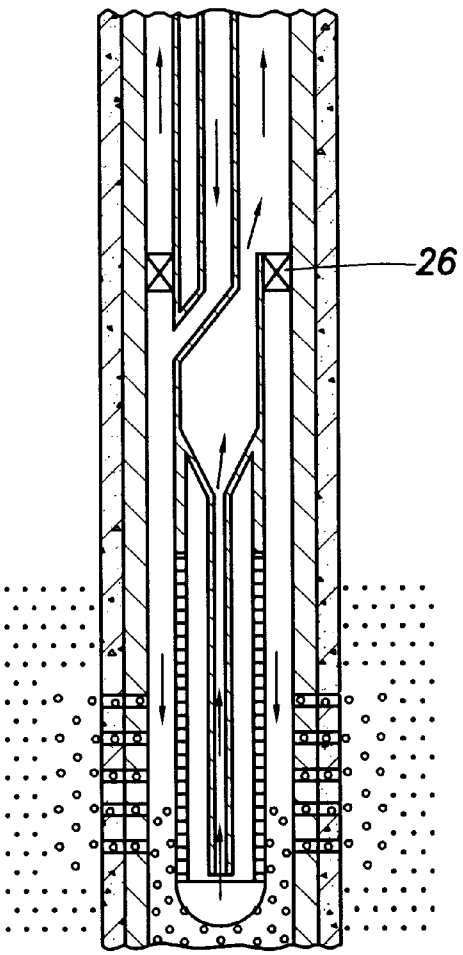
FIG.3c (PRIOR ART)
FIGS. 3*a*, 3*b*, and 3*c* illustrate prior art gravel placement methods for inside casing gravel packs.
Figure 3B:
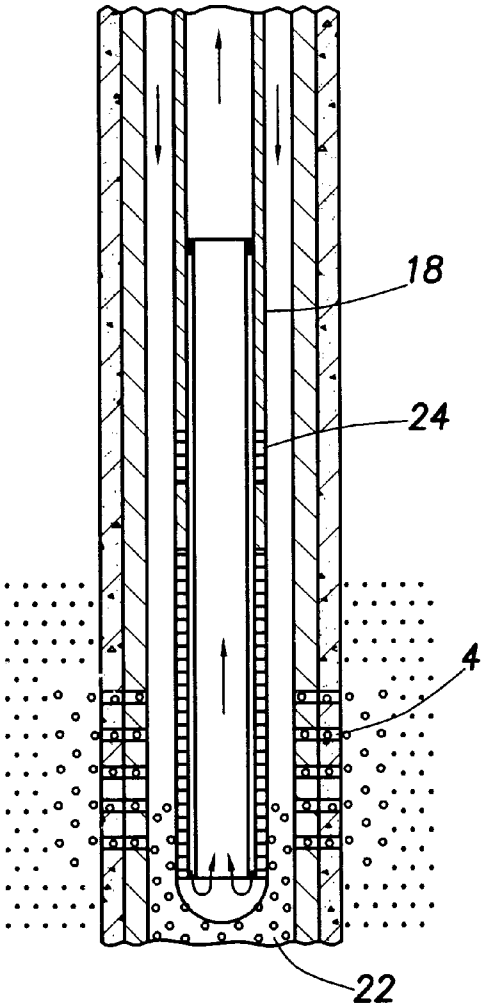
FIG.3b (PRIOR ART)
Figure 3A:
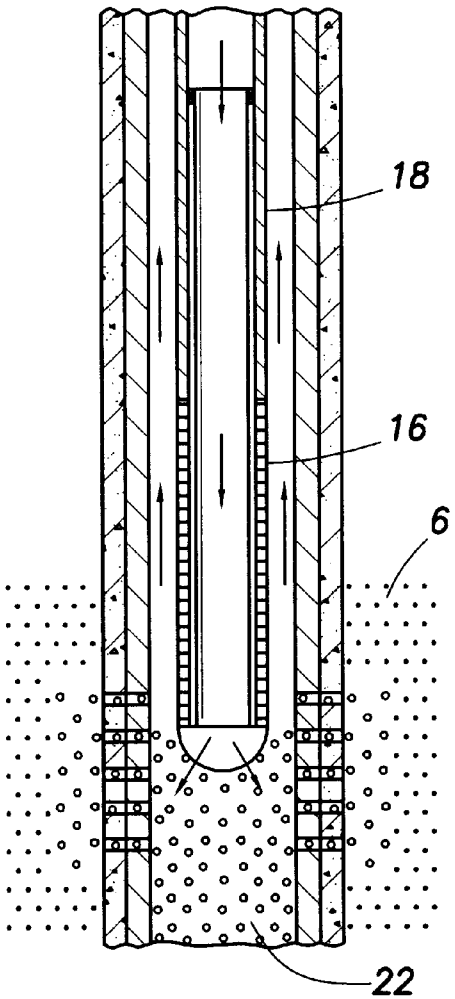
FIG.3a (PRIOR ART)
Figure 4:
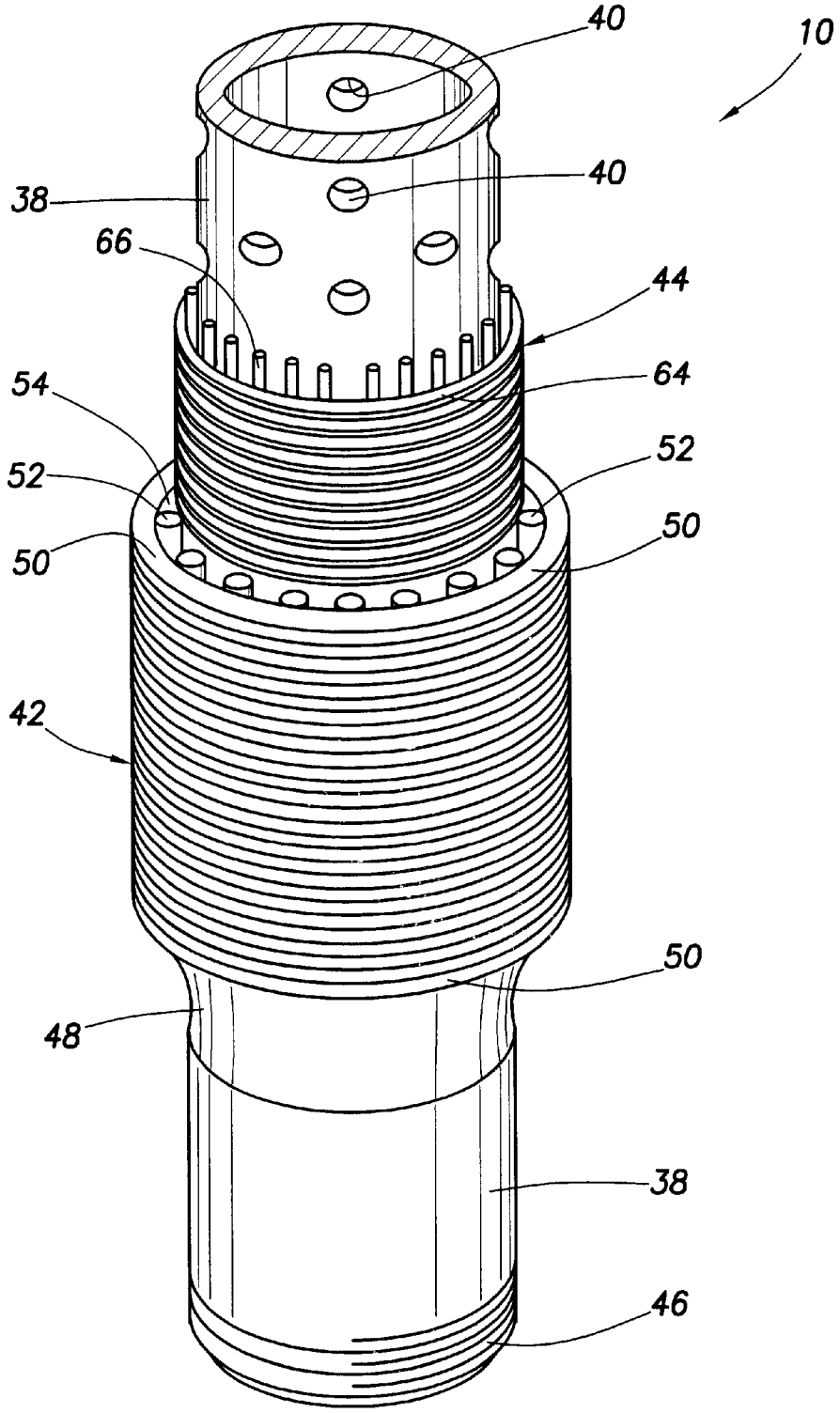
FIG.4 (PRIOR ART)
FIGS. 4 and 5 illustrate prior art gravel packs wherein a wire having a trapezoidal cross section is used to wrap the gravel pack.
Figure 5:
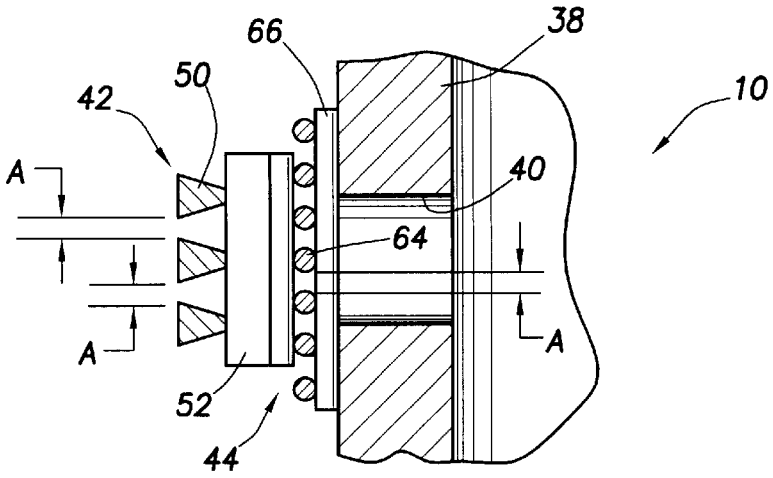
FIG.5 (PRIOR ART)

PATENT NO. : 6,554,064 B1 
DATED : April 29, 2003
INVENTOR(S) : Henry L. Restarick, Clark E. Robinson and Roger L. Schultz It is certified that error appears in the above-identified patent and that said Letters Patent is hereby corrected as shown below:

Column 2,
Lines 27 to 33, please delete whole paragraph "As shown in FIG. 5, the outer screen wire 50 is typically 90 mils wide by 140 mils tall in a generally trapezoidal cross-section. The maximum longitudinal spacing A between adjacent turns of the outer wire wrap is determined by the maximum diameter of the fines that are to be excluded. Typically, the aperture spacing A between adjacent wire turns is 20 mils."
and insert paragraph -- In deviated wells, gravel packing is greatly complicated by the fact that the gravel tends to settle to the low side of the hole, forming a dune in the casing-screen annulus. This problem is significant at deviations greater than 45° from vertical. Gravel placement is improved in deviated wells by using a washpipe that is large relative to the screen because this causes a higher velocity over the dune in the annulus between the screen and the casing by increasing the resistance to flow in the screen-wash-pipe annulus. --

Signed and Sealed this

Twenty-seventh Day of April, 2004

JON W. DUDAS
*Acting Director of the United States Patent and Trademark Office*